United States Patent [19]

Genovese

[11] 4,294,901

[45] Oct. 13, 1981

[54] THERMOREMANENT MAGNETIC IMAGING MEMBER AND SYSTEM

[75] Inventor: Frank C. Genovese, Fairport, N.Y.

[73] Assignee: Xerox Corporation, Stamford, Conn.

[21] Appl. No.: 203,207

[22] Filed: Nov. 3, 1980

[51] Int. Cl.[3] ..... G03G 19/00

[52] U.S. Cl. ..... 430/39; 346/74.4; 360/55; 430/62

[58] Field of Search ..... 430/39; 346/174.4; 360/59

[56] References Cited

U.S. PATENT DOCUMENTS 3,804,511 4/1974 Rait et al. .

3,845,306 10/1974 Kohlmannsperger .

3,995,278 11/1976 Young ..... 346/74.4

*Primary Examiner*—John D. Welsh

*Attorney, Agent, or Firm*—R. J. Grandmaison; E. O. Palazzo

[57] ABSTRACT

A magnetic imaging process and imaging member comprising an electrically conductive layer overcoated with an electrically resistive layer wherein a latent magnetic image is formed on the imaging member by heating selected portions thereof. The latent image is then developed by contacting the imaging member with a magnetic toner composition. The developed image is transferred to a permanent substrate and fixed thereto.

10 Claims, 4 Drawing Figures

THERMOREMANENT MAGNETIC IMAGING MEMBER AND SYSTEM

This invention relates to magnetic imaging and, more particularly, to the provision of a method for generating magnetic images.

It is known that a magnetic imaging system which employs a latent magnetic image on a magnetizable recording medium can then be utilized for purposes such as electronic transmission or in a duplicating process by repetitive toning or transfer of the developed image. Such latent magnetic image is provided by any suitable magnetization procedure whereby a magnetizable layer of marking material is magnetized and such magnetism transferred imagewise to the magnetic substrate. Such a process is more fully described in U.S. Pat. No. 3,804,511 to Rait et al.

As is disclosed in that patent, an optical image can be reproduced by first reducing it to a graphical image but employing a magnetizable marking material. Such magnetizable material is typically electroscopic toner comprising a ferromagnetic material which, after image formation, is susceptible to magnetization. There is thus formed an imagewise pattern of magnetization which pattern is then transferred to a magnetic substrate by any one of several methods as disclosed in the patent. Preferably, the magnetization in imagewise pattern is produced in a magnetic substrate by the anhysteretic method whereby the magnetized graphic image is brought into intimate contact with a magnetic substrate and while in contact is subjected to an A.C. signal from a recording head. The magnetic substrate is thereby magnetized in image configuration in accordance with the graphic image. Other methods of utilizing the magnetized graphic image for producing a latent magnetic image are also disclosed such as by providing intimate contact between the graphic magnetic material and a previously uniformly magnetized substrate and applying an erase signal through the graphic image support thereby applying the magnetic image as a shunt for the erase signal. There is then produced by selective erasure in background areas a latent magnetic image in those areas shunted by the magnetic graphic image. Various other methods of providing such latent image utilizing a previously formed magnetizable graphic image are disclosed in the patent referred to above.

After formation, the latent magnetic image may be developed, that is, made visible by contact with magnetic marking material such as a toner composition. Subsequent to development of the latent magnetic image, it is usually desirable to transfer the toner image from the magnetic imaging member to a permanent substrate such as paper.

As disclosed in U.S. Pat. No. 3,845,306, it is also known to produce a magnetic image of an original by applying to a uniformly premagnetized surface a thermal image wherein the temperature of certain portions exceeds the Curie point. Such magnetic images can be converted into powder images by utilizing a magnetic toner. It is further known to subject a layer of magnetizable toner to the action of an external magnetic field and to simultaneously expose onto the magnetizable toner a thermal image wherein the temperature of certain portions exceeds the Curie point. This brings about a selective removal or transfer of pulverulent toner so that the residual toner or the removed toner forms a powder image. It has also been proposed to bring a magnetic layer in contact with a control layer wherein certain portions are heated above the Curie point to thus provide on the magnetic layer a permanent magnetic image of the original.

Another form of magnetic data recording is known as thermoremanent writing. In thermoremanent writing, the magnetic record member is heated above its magnetic transition temperature in the presence of an external magnetic field. The result is that the point of interest is selectively magnetized. Selective modification of the information is possible by the same process of heating and cooling, but without an external magnetic field being applied, or with cooling in the presence of a magnetic field being applied, or with cooling in the presence of a magnetic field of polarity opposite to the field applied.

Thermoremanent imaging has also been proposed as a technique for generating magnetic images in thin films or coatings. In such technique, the film or coating is heated locally above the Curie temperature and allowed to cool in the presence of an external magnetic field which is then "captured" only in the heated areas. The inverse approach of erasing selected portions of a previously magnetized film or coating is equivalent in principle where a zero field is "captured".

However, existing magnetic image generation methods and apparatus suffer from high costs, manufacture is complicated and very difficult, and image quality goals are seldom achieved. Thermal writing at present is a relatively slow process since power levels high enough to generate images cause irreversible damage to the surface of the imaging member. It is an intrinsic limitation of present systems used to generate images on heat-sensitive surfaces to diffuse heat from the surface to the marking interface in a very short time. This technique of thermal writing has been demonstrated but has poor resolution and is very slow. Slow thermal response can be partially compensated for with very thin heaters overdriven to create high thermal gradients, however, cooling is still slow in preparation for subsequent writing cycles. To improve resolution, a high-powered energy source may sufficiently localize the energy, however, such also causes irreversible surface damage.

Therefore, it is an object of the present invention to provide a thermoremanent magnetic imaging process and apparatus which overcome the above-noted disadvantages.

It is a further object of this invention to provide a magnetic imaging recording element which enables faster writing speeds.

It is a further object of this invention to provide a magnetic imaging recording system which is cheaper and easier to fabricate.

It is another object of this invention to provide a magnetic imaging recording system which requires less electrical energy.

It is another object of this invention to provide a direct magnetic image marking method from an electrical source.

In accordance with the present invention, generally speaking, there is provided multi-layered or sandwich structures for thermoremanent magnetic imaging and a method for employing such structures in direct marking techniques to provide magnetic imaging masters. In one embodiment of this invention, a conductive stylus provides a current through a magnetizable sandwich member to heat selected portions of the member in image configuration to about the Curie temperature of the member. A magnetic latent image is formed when the heated portion of the member is allowed to cool in an externally applied magnetic field at a strength of between about 10 and about 200 gauss. In another embodiment of this invention, the sandwich member is premagnetized and the background image areas of the member are heated to about the Curie temperature. The sandwich member is thereafter cooled in the absence of any externally applied magnetic field.

More specifically, both aforementioned embodiments comprise a thermoremanent magnetic imaging sandwich structure comprising a highly conductive ground plane overcoated with an electrically resistive layer. In one embodiment, the resistive layer contains aligned magnetic particles having a low Curie temperature, such as chromium dioxide, and sufficient conductive additive such as carbon in a polymer binder to yield a net resistivity when cured of approximately 0.5 ohm-cm. Such a carbon-binder matrix can be formulated to provide excellent high temperature toughness and mechanical wear properties. In another embodiment, the conductive ground plane and resistive layer are applied separately over a separate magnetic layer. In each embodiment, heat is generated in a circular volume confined within the resistive layer beneath a stylus or probe when a potential difference is applied between the probe and the ground plane. In the first embodiment, heat is generated within the film containing the magnetic material and is thermally efficient since the magnetic particles are thermally immersed. In the second embodiment, heat is diffused through the ground plane to the magnetic layer and some spreading may occur. However, in both embodiments, current from adjacent probes does not interfere where the ground plane is a good conductor.

Thus, by fabricating flexible plastic conductors having magnetic properties, structures having magnetic imaging properties and a reliable ohmic contact surface with a resistivity tailored for low voltage TTL or thin film transistor drivers having flexibility and toughness characteristics are provided. Sandwich structures with a high resistivity carbon-loaded layer bonded on top of a highly conductive ground plane layer of less than about 0.01 ohm-cm$^2$ may be fabricated in this fashion. The low resistivity layer has been found to restrict heating to a volume directly under the probe where the bulk resistivity is high and there is a local concentration of current density.

This invention will be better understood by reference to the accompanying drawings in which FIG. 1 is an enlarged side view of one embodiment of the thermoremanent magnetic imaging sandwich structures of this invention.

Figure 1:
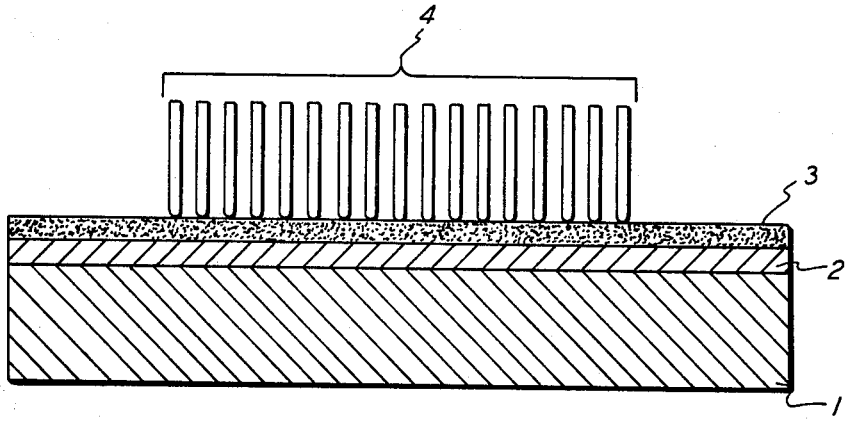

Referring to FIG. 1, there is shown in cross section, greatly enlarged, a side view of a magnetic imaging sandwich structure of this invention. The sandwich structure comprises a support substrate 1 comprising a polymer resin or a diamagnetic material such as brass. Over substrate 1 is a layer 2 of a highly electrically conductive material. Layer 2 may generally be referred to as a ground layer or "ground plane". Overlying layer 2 is a homogeneous resistive layer 3 comprising aligned magnetic particles having a low Curie temperature and sufficient electrically conductive additive, such as carbon, in a high temperature polymer binder to yield a net resistive when cured of approximately 0.5 ohm-cm. Positioned adjacent to resistive layer 3 may be between 2,000 and 8,000 individually controlled electrical contact points provided by conductive styli 4. Conductive styli 4 provide electrical current through the imaging member and heat selected portions of the member in image configuration to about the Curie temperature of the magnetic particles. A magnetic latent image is formed as the heated portions of the member are allowed to cool in the presence of an externally applied magnetic filed (not shown). Where desired, support substrate 1 may be omitted since the essential layers of the imaging member comprise conductive layer 2 and resistive layer 3. However, support substrate 1 may be employed where greater flexible handling properties of the imaging member are desired.

Figure 2:
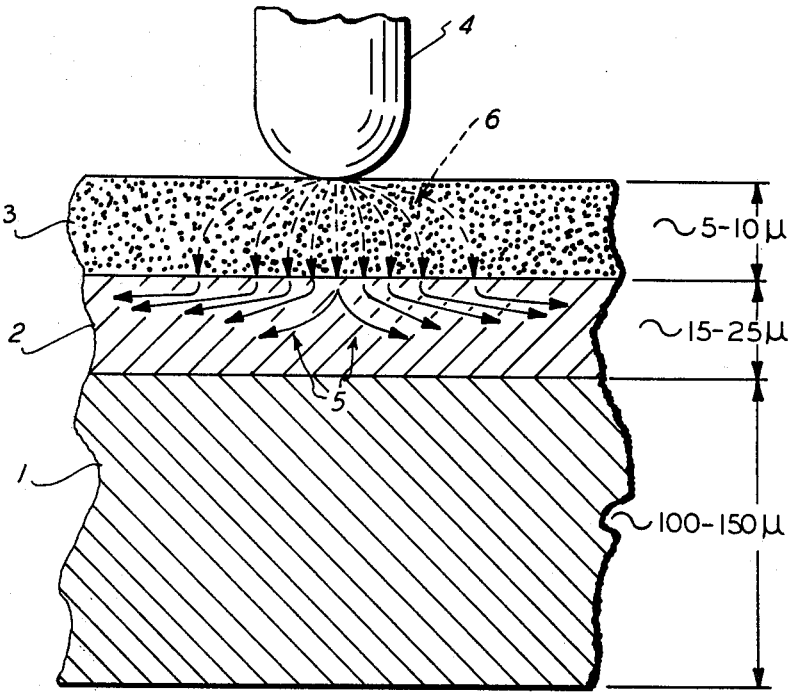
FIG. 2 is an enlarged side view depicting approximate current paths and the heating zone for one probe tip from a conductive styli and the approximate thicknesses of the various layers in the imaging structure of FIG. 1.

Referring now to FIG. 2, there is shown substrate 1 having an approximate thickness of between about 100 microns and about 150 microns. Overlying substrate 1 is conductive layer 2 having an approximate thickness of between about 15 microns and about 25 microns wherein approximate current paths 5 from greatly enlarged probe tips or conductive styli 4 are depicted. Overlying layer 2 is resistive layer 3 having an approximate thickness of between about 5 microns and about 10 microns wherein heating zone 6 is depicted from probe tip 4.

Figure 3:
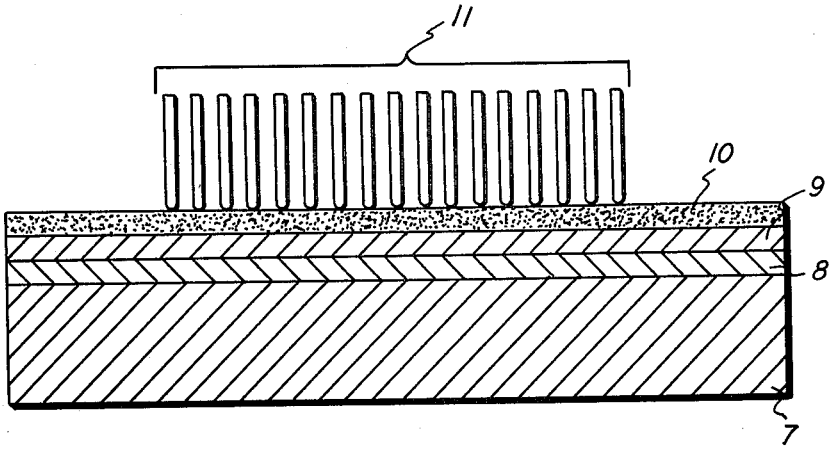
FIG. 3 is an enlarged side view of another embodiment of the thermoremanent magnetic imaging sandwich structure of this invention.

Referring now to FIG. 3, there is shown in cross section, greatly enlarged, a side view of another embodiment of a magnetic imaging sandwich structure of this invention. The sandwich structure of this embodiment consists of a substrate 7 which may comprise the same materials as substrate 1. Overlying substrate 7 is a magnetic layer 8 containing magnetic particles in a binder material. Overlying layer 8 is a highly electrically conductive layer 9. Overlying layer 9 is a homogeneous resistive layer 10 comprising carbon in a high temperature binder. Positioned adjacent to resistive layer 10 may be between 2,000 and 8,000 individually controlled contact points provided by conductive styli 11. Conductive styli 11 provide electrical current through resistive layer 10 and conductive layer 9 and heat selected portions of magnetic layer 8 in image configuration to about the Curie temperature of the magnetic particles. As in FIG. 1, the support substrate 7, may be omitted.

Figure 4:
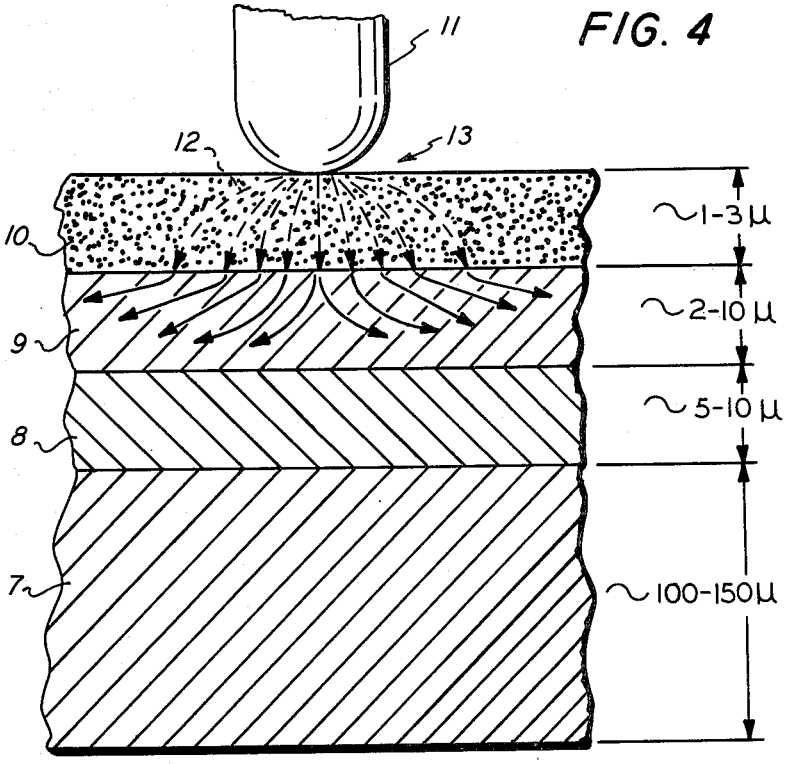
FIG. 4 is an enlarged side view depicting approximate current paths and the heating zone for one probe tip from a conductive styli and the approximate thicknesses of the various layers in the imaging structure of FIG. 3.

Referring to FIG. 4, there is shown substrate 7 having an approximate thickness of between about 100 microns and about 150 microns. Overlying substrate 7 is magnetic layer 8 having an approximate thickness of between about 5 microns and 10 microns. Overlying layer 8 is conductive layer 9 having an approximate thickness of between about 2 microns and 10 microns. Overlying layer 9 is resistive layer 10 having an approximate thickness of between about 1 micron and 3 microns. Approximate current paths 12 from greatly enlarged probe tip or conductive styli 11 providing heating zone 13 are also depicted. In operation, the heat generated by probe tip 11 diffuses through resistive layer 10 and conductive layer 9 to magnetic layer 8.

Substrates 1 and 7 may comprise any suitable polymer or diamagnetic material. Typical substrate materials include flexible resins and diamagnetic metals such as brass. However, it is preferred that substrates 1 and 7 comprise a resin material because of its availability in large, thin sheet form and provides an imaging member having flexibility.

Conductive layers 2 and 9 may comprise any suitable electrically conductive material. Typical electrically conductive materials include carbon black, carbon dispersions, aluminum, brass, and beryllium copper.

Resistive layer 3 may comprise any suitable high temperature resin binder material, an electrically conductive component, and a magnetic component. Resistive layer 10 may comprise the same materials as resistive layer 3 except for the absence of a magnetic component. The binder material should have good dispersing properties for both the conductive and magnetic components. It should also form smooth coatings when cast from a solution or dispersion, adhere well to a substrate, and exhibit mechanical and chemical integrity during coating preparation and use at elevated temperatures. Naturally, the binder material should have a glass transition temperature above the Curie temperature of the magnetic imaging component. The magnetic component preferably comprises chromium dioxide because of its reasonably low Curie temperature of about 130° C., its dispersibility in polymer binders, and its historical success as a recording medium.

The probe tips or conductive styli 4 and 11 may comprise any suitable electrical element. Styli 4 and 11 may comprise a linear array of closely-spaced metal probes. Each stylus tracks a single column in the image to be generated and is controlled electronically to produce the proper sequence of pulses to create the desired image. Obviously, the higher the image resolution desired, the larger the number of styli that will be needed. The stylus array may comprise 2,000 to 4,000 and even up to 8,000 evenly spaced contacts at about 200 to 400 per inch in an arrangement that permits them to slide smoothly over the image receptor surface without electrical interruption and to minimize wear. If the imaging member is rigid, the stylus contact should be compliant to assure tracking and adequate contact. For compliance, a springy or elastomeric stylus array is preferred. Such an array may take the form of nubs of metal in parallel rows or cantilevered leaf springs with one end free to create the contact.

In operation, this invention comprises a thermoremanent imaging technique that creates a latent magnetic image on a conductive, magnetic image receptor. The image is generated by locally heating the image receptor with current pulses from a closely spaced stylus array. By internal ohmic heating, the magnetic particles in the image receptor are heated causing a change in their magnetic state. The resulting image is then developed with magnetic toner particles and subsequently transferred to a permanent substrate such as paper and fused thereto.

Development of the latent magnetic image is accomplished by contacting it with a toner composition comprising a fusible resinous component and a magnetically attractable component. The magnetically attractable component may be present in the toner in the amount of about 20% by weight to about 90% by weight, based on the weight of the toner. The developed image is then contacted with a receiving member to which pressure may be applied and the image thereby transferred thereto. After transfer of the image to the receiving member, the image is fixed thereto. Any fixing method can be employed. Typical suitable fixing methods include heating the toner in the developed image to cause the resins thereof to at least partially melt and become adhered to the receiving member, the application of pressure to the toner optionally accomplished with heating such as the use of a heated roller, solvent or solvent vapor to at least partially dissolve the resin component of the toner, or any combination of the above. The receiving member is typically sufficiently hard to allow fixing solely by the application of pressure such as, for example, by a contact roller in an amount sufficient to calender the toner. These techniques are conventional in the art of fixing of toner and need not be elaborated upon herein.

Any suitable development technique can be employed for the development of the latent magnetic image residing on the imaging member. Typical suitable development methods include cascade development, powder cloud development, and liquid development. It will be appreciated, of course, that, if electrostatic transfer techniques are employed, the toner utilized at the development station contains an electrostatically attractable component.

Any suitable magnetizable toner composition may be employed in the imaging method of this invention. Typical magnetizable toner compositions include an electrostatically attractable component such as gum copal, gum sandarac, cumarone-indene resin, asphaltum, gilsonite, phenolformaldehyde resins, resin-modified phenolformaldehyde resins, methacrylic resins, polystyrene resins, epoxy resins, polyester resins, polyethylene resins, vinyl chloride resins, and copolymers or mixtures thereof. However, it is preferred that the electrostatically attractable component be selected from polyhexamethylene sebacate and polyamide resins because of their fusing properties. Among the patents describing toner compositions are U.S. Pat. Nos. 2,659,670 issued to Copley: 2,753,308 issued to Landrigan; 3,070,342 issued to Insalaco; Re. 25,136 to Carlson, and 2,782,288 issued to Rheinfrank et al. These toners generally have an average particle diameter in the range substantially 5 to 30 microns.

If desired, any suitable pigment or dye may be employed as a colorant for the toner particles. Colorants for toners are well known and include, for example, carbon black, nigrosine dye, aniline blue, Calco Oil Blue, chrome yellow, ultramarine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable magnetic or magnetizable substance may be employed as the magnetically attractable component for the toner particles. Typical magnetically attractable materials include metals such as iron, nickel, cobalt, ferrites containing nickel, zinc, cadmium, barium, and manganese; metal oxides such as $F_2O_3$ and $Fe_3O_4$ or magnetite and hematite; metal alloys such as nickel-iron, nickel-cobalt-iron, aluminum-nickel-cobalt, copper-nickel-cobalt, and cobalt-platinum-manganese. Preferred for the instant process are magnetite and iron particles as they are black in color, low cost and provide excellent magnetic properties. The magnetic component particles may be of any shape and any size which results in magnetic toner particles having uniform properties. Generally, the magnetic component particles may range in size from about 0.2 microns to about 1 micron. A preferred average particle size for the magnetic component particles is from about 0.1 to about 0.5 micron average diameter because such provides for easier and more uniform distribution in the toner particles.

As earlier indicated, in accordance with this invention, it has been found that the thermal energy required in thermoremanent imaging should be generated within the magnetic layer itself rather than conducted in from the outside surface. Where heat is generated internally, the time required for the temperature to relax to the ambient is immaterial since each part of the imaging surface is heated only one time per image. Such provides an intrinsically fast magnetic writing system and obviates image smear caused by the relative motion of a slowly cooling heating device moving across an imaging surface.

Thus, in accordance with this invention, internal heating of the imaging structure is provided by making the imaging structure resistive through the presence of a resistive material which is forced to conduct an electric current. Heat is generated wherever current flows and, since the magnetic component and the electrically conductive component are in intimate thermal contact, heat exchange between them is essentially instantaneous. The presence of conductive component in the binder layer necessarily displaces some magnetic component, but does not otherwise interfere with its magnetic effectiveness. The separation of magnetic and conductive functions permits independent adjustment and control of the properties of the composite imaging structure and greatly simplifies its formulation. Also, the resistivity of the imaging structure can be easily adjusted over a wide range of values with the controlled addition of various amounts of conductive component. The resistivity of the imaging structure can thereby be brought to essentially any desired value with very little total displacement of the magnetic component.

As indicated, writing of the imaging structure of this invention is obtained with an array of electrically conductive styli. The simplest path for the heat-generating current is through the imaging structure from its surface to the conductive plane or substrate. The conductive plane must be highly conductive whereas conventional magnetic tapes have an insulating substrate. Since the electric current passes through the imaging structure, the current path is equal to the structure thickness and is very short, typically 5 to 15 microns. The result is that relatively high bulk resistivities, consistent with low conductive component concentrations having a minimum displacement of magnetic component can be used to form low load resistances. The thickness and uniformity of the imaging structure can be controlled to close tolerances with modern coating technology so that power dissipation is uniform and the image receptor behaves the same at each point. Only one contact per circuit is needed since the substrate is the common return path.

Further, the magnetic imaging process of this invention relies upon the thermoremanent behavior of single-domain magnetic particles held in place by an inert binder that has been applied to a suitable substrate in a thinly coated imaging structure. The properties of the magnetic component are such that, above a certain critical temperature, its ferromagnetic properties are lost. However, such loss of magnetic characteristics is reversible so that the magnetic behavior is a well-defined function of temperature. This effect is due to competition between magnetic forces trying to keep spins parallel, and randomizing thermal forces. At low temperature, spins are aligned. As temperature rises, the alignment probability is reduced until the composition eventually completely loses its ferromagnetic properties. Depending to some extent on crystal geometry and the presence of impurities, the critical temperature or Curie point for chromium dioxide is about 130° C. In effect, when a magnetized particle is heated to or beyond its Curie point, any data or information implied by its polarization state is lost when the imaging structure is subsequently cooled. For a large ensemble of magnetic particles, final states will be microscopically random in distribution and yield no net macroscopic magnetization. However, the presence of a small external bias field induces the formation of a specific polarization state upon cooling; each particle contributes collectively to the net magnetization, and the imaging structure appears strongly magnetized. Where no external field is applied, the imaging structure is considered to have undergone Curie erasure. Conversely, Curie writing takes place when the bias field is applied.

In use, the electrical contact between the probe or stylus and the image receptor should meet certain requirements. In order that only a small mark be produced on the image receptor, heating should be restricted to a very limited area by contact over a correspondingly small region, for example, about 100 to 500 square microns. This may be accomplished by limiting the physical size of the stylus or the radius of its tip. Also, mechanical force sufficient to maintain good electrical contact should be applied to the stylus.

As will be appreciated, the image receptor of this invention is similar in magnetic properties to conventional recording tape being composed of a thin film containing magnetically active particles held together in a binder that has been coated on the surface of a suitable substrate material. However, the electrical properties of the image receptor of this invention are distinctly different from conventional recording tape, and the thermoremanent properties of the active particles are of critical importance. By comparison, the thermoremanent properties of commercial magnetic tape are immaterial as long as high temperatures are not encountered during use or in storage. Advantageously, chromium dioxide may be used to record thermoremanently at a relatively low temperature. However, although chromium dioxide is highly conductive, when dispersed in an insulating resin binder, the particles fail to form electrically conductive paths. In order to obtain the required degree of conductivity herein, conductive particles such as carbon black are added to the resin binder of the resistive layer.

In summary, it has been found that thermoremanent magnetic imaging members and a magnetic imaging process may be provided by a thermoremanent magnetic multi-layered structure comprising a substrate, a highly conductive ground plane, an electrically resistive layer, and thermoremanent magnetic particles, in combination with electrically conductive styli. Internal heating of the imaging structure enables a fast magnetic writing system and prevents image smearing problems of conventional systems.

Although specific materials and conditions are set forth in the foregoing disclosure, these are merely intended as illustrations of the present invention. Various other suitable resins, magnetizable materials, magnetic substances, additives, pigments, colorants, and/or other components may be substituted for those above with similar results. Other materials may also be added to the recording member to sensitize, synergize or otherwise improve the imaging properties or other properties of the system.

Other modifications of the present invention will occur to those skilled in the art upon a reading of the present disclosure. These are intended to be included within the scope of this invention.

What is claimed is:

1. A magnetic imaging process comprising:

(a) providing a thermoremanent magnetic imaging member comprising a substrate, an electrically conductive layer over said substrate, and an electrically resistive layer over said conductive layer wherein said resistive layer comprises aligned magnetic particles and electrically conductive particles dispersed in a polymer binder;

(b) forming a latent magnetic image on said imaging member by heating selected portions of said imaging member to about the Curie temperature of said magnetic particles and allowing the heated portions of said imaging member to cool in the presence of an externally applied magnetic field;

(c) developing said latent magnetic image by contacting said imaging member with a magnetic toner composition comprising a fusible resinous component and a magnetically attractable component;

(d) transferring the developed image to a receiving member; and (e) fixing the transferred image to said receiving member.

2. A magnetic imaging process in accordance with claim 1 wherein said heating of said imaging member is provided by applying a potential difference between an electrically conductive stylus in contact with said resistive layer and said electrically conductive layer.

3. A magnetic imaging process in accordance with claim 2 wherein said resistive layer possesses a net resistivity of about 0.5 ohm-cm.

4. A magnetic imaging process in accordance with claim 1 wherein said magnetic particles comprise chromium dioxide.

5. A magnetic imaging process in accordance with claim 1 wherein said electrically conductive particles comprise carbon black.

6. A magnetic imaging process in accordance with claim 1 wherein said electrically conductive layer is selected from aluminum, brass, and beryllium copper.

7. A magnetic imaging process in accordance with claim 6 wherein said magnetic field is applied at a strength of between about 10 and about 200 gauss.

8. A magnetic imaging process comprising:

(a) premagnetizing a magnetic imaging member comprising a substrate, a thermoremanent magnetic layer over said substrate, an electrically conductive layer over said magnetic layer, and an electrically resistive layer over said conductive layer wherein said resistive layer comprises a conductive dispersed in a polymer binder;

(b) forming a latent magnetic image on said imaging member by heating selected portions of said imaging member to about the Curie temperature of said magnetic layer and allowing the heated portions of said imaging member to cool;

(c) developing said latent magnetic image by contacting said imaging member with a magnetic toner composition comprising a fusible resinous component and a magnetically attractable component;

(d) transferring the developed image to a receiving member; and (e) fixing the transferred image to said receiving member.

9. A magnetic imaging member comprising:

(a) an electrically conductive layer; and (b) an electrically resistive layer over said conductive layer wherein said resistive layer comprises aligned magnetic particles and electrically conductive particles dispersed in a polymer binder.

10. A magnetic imaging member comprising:

(a) a magnetic layer;

(b) an electrically conductive layer over said magnetic layer; and (c) an electrically resistive layer over said conductive layer wherein said resistive layer comprises a conductive component dispersed in a polymer binder.

* * * * *